US005400511A

United States Patent [19]

Decker

[11] Patent Number: 5,400,511

[45] Date of Patent: Mar. 28, 1995

[54] THUMBPIECE FOR MODULAR POWER-DRIVEN KNIFE

[75] Inventor: Richard B. Decker, Vermilion, Ohio

[73] Assignee: Bettcher Industries, Inc., Biringham, Ohio

[21] Appl. No.: 96,938

[22] Filed: Jul. 26, 1993

Related U.S. Application Data

[63] Continuation-in-part of Ser. No. 590,026, Sep. 28, 1990, Pat. No. 5,230,154.

[51] Int. Cl.[6] ..... B26B 27/00

[52] U.S. Cl. ..... 30/295; 30/298; 16/110 R; 16/114 R; 16/DIG. 12

[58] Field of Search ..... 30/276, 286, 295, 296.1, 30/298; 16/110 R, 114 R, DIG. 12

[56] References Cited

U.S. PATENT DOCUMENTS

| | | | |
|---|---|---|---|
| Re. 25,947 | 12/1965 | Bettcher . | |
| 108,141 | 10/1870 | Houseman et al. . | |
| 309,131 | 12/1884 | Carter . | |
| 1,532,822 | 4/1925 | Kemp . | |
| 1,784,334 | 12/1930 | Callum | 30/295 |
| 2,217,100 | 10/1940 | Burns | 30/295 |
| 2,350,494 | 6/1944 | Champlin et al. . | |
| 2,827,657 | 3/1958 | Bettcher . | |
| 2,877,018 | 3/1959 | Turner . | |
| 3,014,276 | 12/1961 | Prohaska . | |
| 3,122,774 | 3/1964 | Lamb . | |
| 3,197,808 | 8/1965 | Mears . | |
| 3,269,010 | 8/1966 | Bettcher . | |
| 3,605,842 | 9/1971 | Kuri . | |
| 3,688,403 | 9/1972 | Bettcher . | |
| 3,852,882 | 12/1974 | Bettcher . | |
| 3,971,094 | 7/1976 | Solf et al. . | |
| 4,050,003 | 9/1977 | Owings et al. . | |
| 4,102,049 | 7/1978 | Harth . | |
| 4,116,440 | 9/1978 | Takeshima . | |
| 4,142,291 | 3/1979 | Bettcher . | |
| 4,161,051 | 7/1979 | Brodwin . | |
| 4,166,317 | 9/1979 | Bettcher . | |
| 4,169,047 | 10/1979 | Heckman . | |
| 4,170,063 | 10/1979 | Bettcher . | |
| 4,175,321 | 11/1979 | Bettcher . | |
| 4,178,683 | 12/1979 | Bettcher . | |
| 4,186,924 | 2/1980 | Southey . | |
| 4,198,750 | 4/1980 | Bettcher . | |
| 4,236,531 | 12/1980 | McCullough . | |
| 4,272,077 | 6/1981 | Spivey . | |
| 4,363,170 | 12/1982 | McCullough . | |
| 4,439,924 | 4/1984 | Bettcher . | |
| 4,466,377 | 8/1984 | Kolb et al. . | |
| 4,492,027 | 1/1985 | Bettcher . | |
| 4,494,311 | 1/1985 | McCullough . | |
| 4,509,261 | 4/1985 | Bettcher . | |
| 4,516,323 | 5/1985 | Bettcher et al. . | |

(List continued on next page.)

FOREIGN PATENT DOCUMENTS

| | | | |
|---|---|---|---|
| 643674 | 5/1964 | Belgium . | |
| 883682 | 6/1980 | Belgium . | |
| 611568 | 7/1926 | France | 30/295 |
| 2218975 | 9/1974 | France . | |

OTHER PUBLICATIONS

Honsa Ergonomic Technologies Inc–information sheet for Honsa Erguip. Handle (undated).

*Primary Examiner*—Richard K. Seidel
*Assistant Examiner*—Hwei-Siu Payer
*Attorney, Agent, or Firm*—Watts, Hoffmann, Fisher & Heinke Co.

[57] ABSTRACT

An improved thumbpiece for a power-driven knife is disclosed. The one piece thumbpiece includes an annular base portion and a thumb support portion disposed vertically above the base portion. The base portion is adapted to be mounted on an annular boss extending from the headpiece. The thumb supporting portion includes a thumb contacting surface which extends outwardly at an acute angle with respect to the longitudinal axis of the base portion. The thumb contacting surface is patterned and is generally sinusoidal in profile and convex in cross section for supporting an operator's thumb in a partially flexed position along substantially the entire length of the thumb.

16 Claims, 2 Drawing Sheets

U.S. PATENT DOCUMENTS 4,575,937 3/1986 McCullough .
4,575,938 3/1986 McCullough .
4,590,676 5/1986 Bettcher .
4,601,102 7/1986 Phillips ..... 30/286
4,629,191 12/1986 Mancuso .
4,637,140 1/1987 Bettcher .
4,702,006 10/1987 McCullough .
4,825,548 5/1989 Driggers .
4,854,046 8/1989 Decker et al. .
4,894,915 1/1990 Decker et al. .
4,905,374 3/1990 Schlein .
4,928,457 5/1990 Laperle .
4,941,232 7/1990 Decker et al. .
4,964,192 10/1990 Marui .
4,969,231 11/1990 Mader et al. .
5,031,323 7/1991 Honsa et al. .
5,230,154 7/1993 Decker et al. ..... 30/276

THUMBPIECE FOR MODULAR POWER-DRIVEN KNIFE

RELATED APPLICATION

This is a continuation-in-part of Ser. No. 07/590,026, filed Sep. 28, 1990, and entitled "Modular Power:Driven Rotary Knife, Improved Handle and Method," now U.S. Pat. No. 5,230,154.

FIELD

This invention relates to an improved thumbpiece for a modular power-driven knife.

PRIOR ART

Power-driven knives are widely used in the meat processing industry. A variety of handle shapes and sizes have been proposed to improve the operator's control of the knife during cutting operations and reduce hand fatigue resulting from gripping the knife for extended periods of time. See, for example, U.S. Pat. Nos. 3,014,276; 4,590,676; 4,637,140; and 4,702,006. At least one of these handles, U.S. Pat. No. 4,637,140, includes a thumb rest indentation in the handle of a power-driven knife. U.S. Pat. No. 108,141 discloses a manual knife having a cup shaped thumbpiece aligned with the central axis of the blade and extending outwardly from the upper edge of the knife blade.

SUMMARY OF THE INVENTION

Broadly, the invention provides a modular power-driven knife having an improved thumbpiece. As contemplated for the present invention, the modular power-driven knife includes a handle removably attached to an annular boss extending from a headpiece. The headpiece includes a blade housing and an annular rotary cutting blade. A drive cable extends through a bore in the handle and the annular boss to provide power to the cutting blade via gearing mounted in the headpiece. The improved thumbpiece is mounted on the headpiece boss and is secured between the proximal end of the handle and a shoulder on the headpiece defining the forward terminus of the annular boss.

The thumbpiece is rotatably adjustable with respect to its longitudinal mounting axis. The handle is also, rotatably adjustable with respect to its longitudinal axis. Thus, the thumbpiece's orientation is independent of the handle. An operator may independently adjust the thumbpiece and handle orientation for maximum comfort and control for the particular cutting operation being performed.

The thumbpiece has an annular base portion and an integral thumb support portion mounted on the base portion. The base portion includes an axially extending spline on its inner periphery. The spline interfits with any of a plurality of grooves on the outer periphery of the headpiece boss thereby providing the operator a choice of orientations about the longitudinal mounting axis of the thumbpiece.

As seen in side elevation, with the thumb support portion directly above the annular base portion, the thumb support portion is generally triangular in shape with the longest leg of the triangle being the thumb contacting surface. The thumb contacting surface of the thumb support portion extends outwardly at an acute angle with respect to the central longitudinal axis of the base portion. The acute angle is of sufficient magnitude to alleviate the problem of "lateral pinch" which occurs when the thumb and forefinger of the hand are too close together when a handle is gripped. The thumb contacting surface is generally sinusoidal in profile and is patterned to reduce the likelihood of thumb slippage. The sinusoidal profile of the thumb supporting surface includes a convex portion at its proximal end, followed by a concave portion, terminating at its distal end with a convex portion. The sinusoidal profile of the thumb contacting surface provides support along the entire length of the operator's thumb thereby reducing hand fatigue while simultaneously providing improved control when the blade is moved along a cutting path. When viewed in cross section, the thumb contacting surface is concave or inwardly dished to provide lateral support to the thumb and reduce the possibility of the thumb slipping off the thumbpiece during operation of the knife.

The thumbpiece in use is positioned to locate the operator's thumb laterally of the handle centerline, which provides greater leverage to be applied by the thumb to the blade. Through adjustment of the position of the thumbpiece about the longitudinal axis of the base portion, the leverage provided by the thumb may be advantageously directed relative to the direction of cutting.

The primary object of this invention is to provide an improved thumbpiece for a power-driven knife that reduces hand fatigue resulting from gripping the knife handle over substantial periods of time. A further object of this invention is to provide a thumbpiece that supports the entire length of the thumb both longitudinally and laterally. Another object of this invention is to improve operator control of the knife by utilizing the leverage of the thumb when extended away from the longitudinal axis of the handle. Yet another object of this invention is to reduce "lateral pinch." Still another object of this invention is to provide a thumbpiece that reduces the likelihood of thumb slippage during operation of the knife.

The above and other features of the invention will become better understood from the detailed description that follows, when considered in connection with the accompanying drawings.

DESCRIPTION OF THE PREFERRED EMBODIMENT

Figure 1:
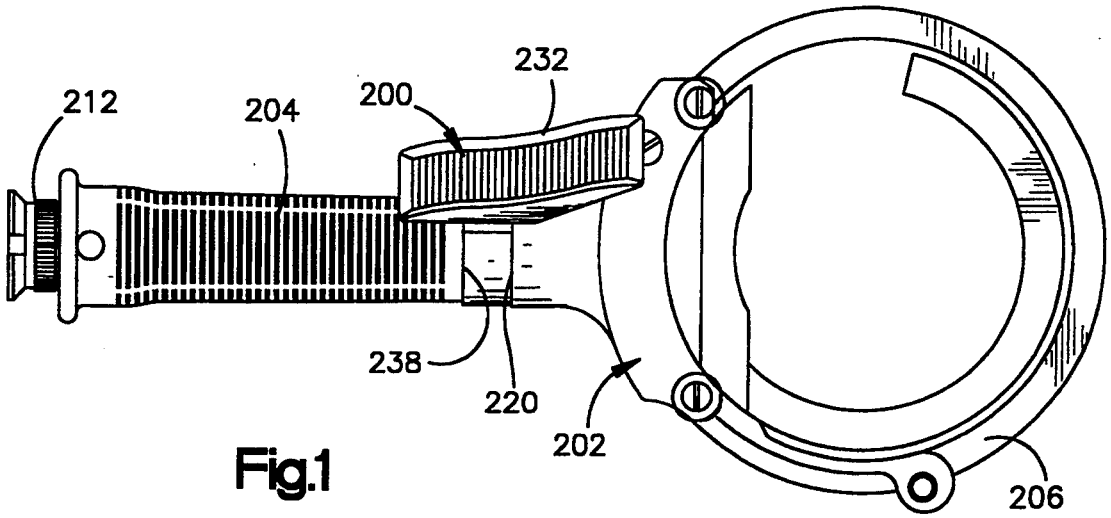
FIG. 1 is a top plan view of a modular power-driven knife including a thumbpiece constructed in accordance with the present invention.
Figure 2:
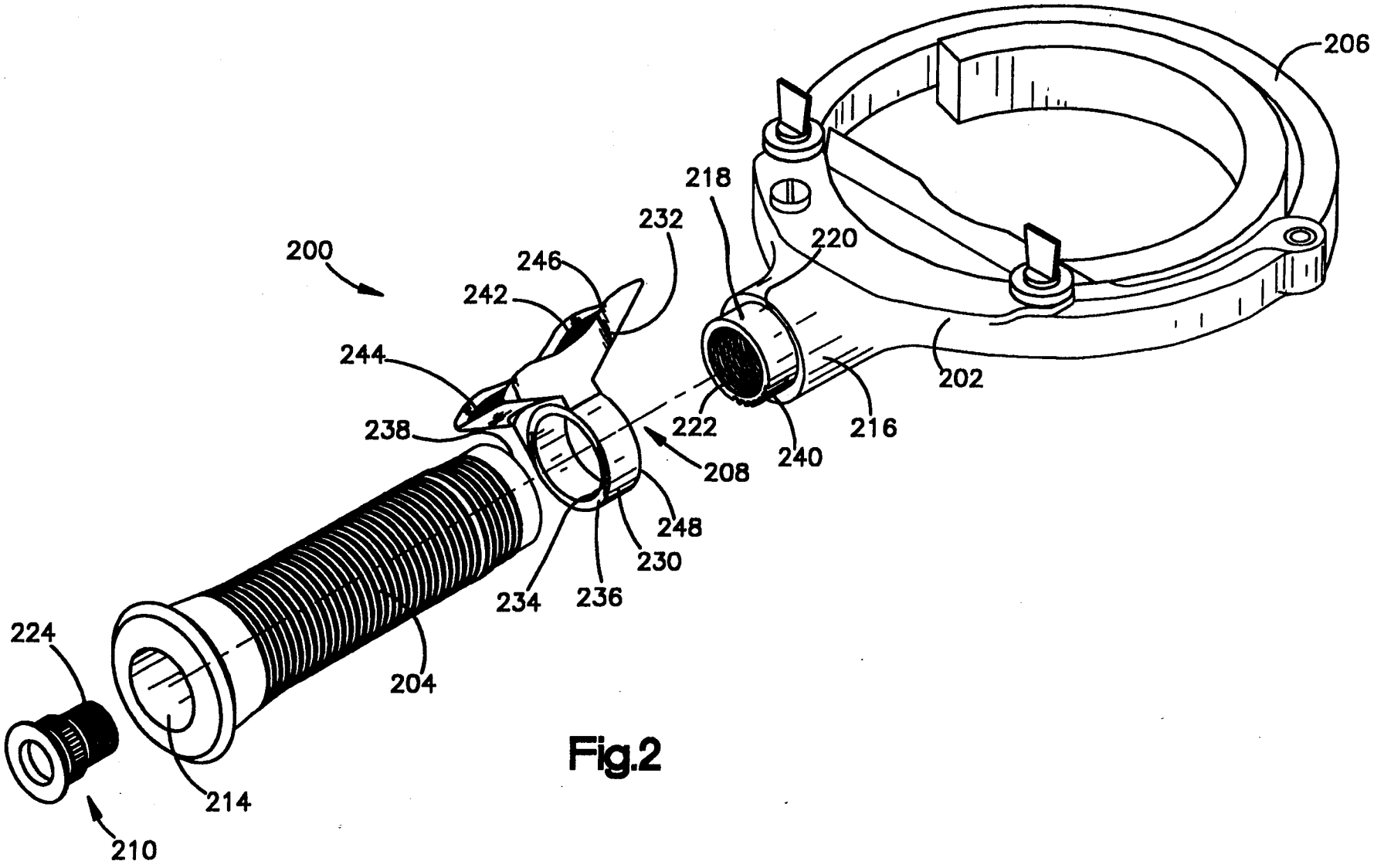
FIG. 2 is an exploded view of the modular power-driven knife of FIG. 1.

With reference to the drawings, FIGS. 1 and 2 show a power-driven modular knife 200 that includes a headpiece 202, a handle 204, a blade housing 206, an improved thumbpiece 208 and a tubular connector insert 210. An annular rotary blade (not shown) is mounted in the blade housing 206 and is powered by a drive cable 212 that extends through a handle bore 214 and co-acts with gears (not shown) mounted in the headpiece 202. A headpiece extension 216 includes an annular boss 218 and a boss shoulder 220. The boss 218 has a central passageway internally threaded 222 to receive corresponding threads 224 on the tubular connector insert 210 to rotatably secure the handle 204 to the headpiece extension 216 in the manner disclosed in Applicant's co-pending application Ser. No. 07/590,026, filed Sep. 28, 1990, issued Jul. 27, 1993 as U.S. Pat. No. 5,230,154, and entitled Modular Power-Driven Rotary Knife, Improved Handle and Method, which is hereby incorporated in its entirety by reference.

Figure 3:
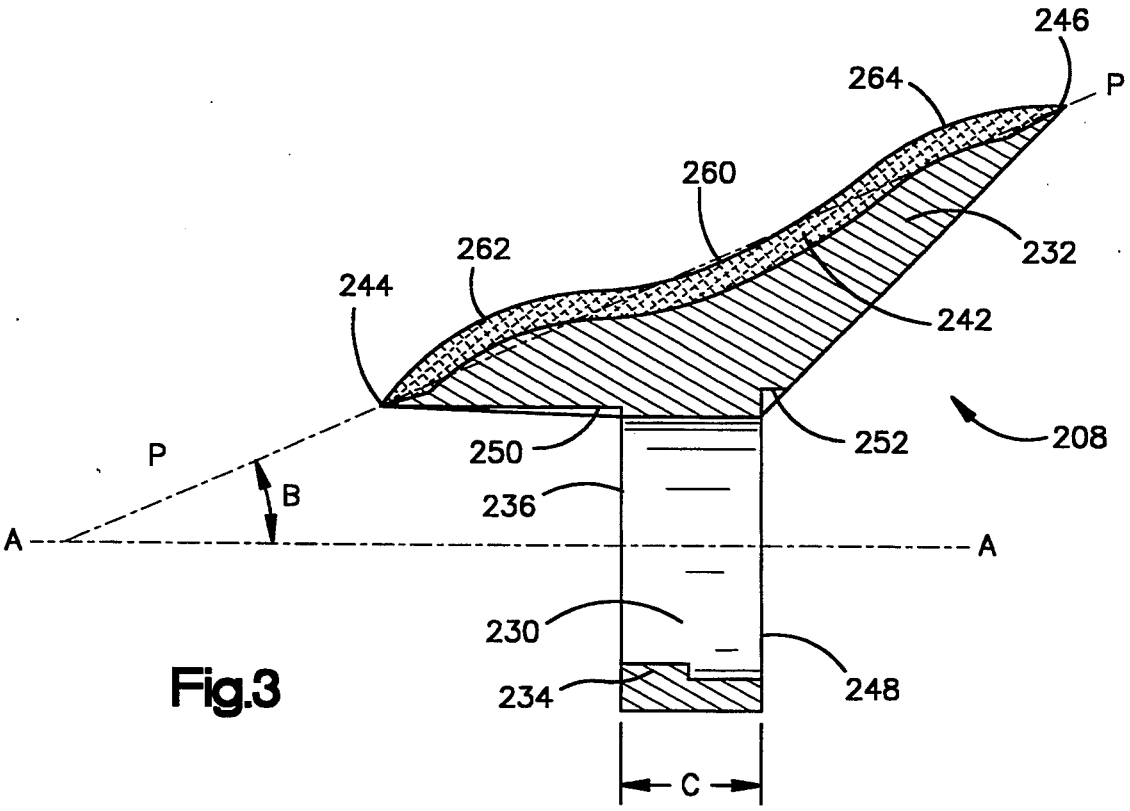
FIG. 3 is a longitudinal sectional view of the thumbpiece of FIG. 1.

The construction of the thumbpiece 208 is best shown in FIGS. 2-3. It is a unitary piece having an annular base or mounting portion 230 and a thumb support portion 232 mounted on the base portion 230 and extending generally in the direction of a longitudinal central axis A-A of the annular base portion. The inner peripheral surface of the base portion 230 includes a raised axially extending spline or key 234. The spline 234 is parallel with the longitudinal axis A—A of the base portion. The spline 234 is diametrically opposite of the thumb support portion 232 and is adjacent an end 236 of the base portion 230. The base portion 230 has an axial length C (shown in FIG. 3) equal to the distance between the boss shoulder 220 and an end 238 of the handle 204 so that when it is mounted on the boss 218 it encircles the boss and is confined axially between the boss shoulder 220 and the handle end 238, as shown in FIG. 1. The length of the spline 234 is approximate one-half the axial length C (shown in FIG. 3) of the base portion 230.

As can best be seen in FIG. 2, the spline 234 is receivable in any one of several (for example, five) grooves 240 in the outer periphery of the boss 218. The peripherally spaced grooves 240 permit the thumbpiece 208 to be located at different positions about the longitudinal axis of the handle 204 to accommodate different thumb positions. When the base portion 230 is mounted on the boss 218, the thumb support portion 232 is offset from the handle centerline. The thumbpiece comfortably receives the operator's thumb (not shown) and enhances the gripping of the handle and the manipulating of the knife. While not shown, additional grooves of the same construction can be provided on the outer periphery of the boss 218 to allow the thumbpiece 208 to be moved to a location on the opposite side of the centerface of the knife for left handed use. The thumbpiece 208 positions the operator's thumb outwardly from the handle centerline, thus providing greater leverage to be applied by the thumb to the blade. Through adjustment of the thumbpiece position about the longitudinal axis of the base portion 230, the leverage provided by the thumb may be advantageously directed relative to, the direction of force to be applied during cutting.

As can be seen in FIG. 3, when the thumbpiece is viewed from the side, the thumb support portion 232 has a proximal end 244 and a distal end 246 and is generally triangular in shape, with the longest leg of the triangle being the thumb contacting surface 242 the thumb contacting surface 242 extends along a longitudinal axis P—P. The thumb contacting surface 242 is patterned with grooves to reduce the likelihood of thumb slippage during use. The length of the thumb contacting surface 242 is sufficient to provide support along substantially the entire length of the operator's thumb (not shown). The profile of the thumb contacting surface 242 is generally sinusoidal in shape along its length. As can be seen in longitudinal cross section in FIG. 3, the sinusoidal thumb contacting surface has a concave middle portion 260 surrounded by proximal and distal convex portions 262, 264. The proximal convex surface portion 262 is adjacent the thumb support portion proximal end 244 while the distal convex surface is adjacent the thumb support portion distal end 246. The contoured profile of the thumb contacting surface is ergonomically designed to allow the operator's first and second thumb joints to be somewhat flexed during operation of the knife for maximum operator comfort and reduced fatigue. In transverse cross section, that is, perpendicular to the longitudinal axis P—P, the thumb contacting surface 242 is concave or inwardly dished, thereby providing lateral support to the operator's thumb and further reducing the likelihood of thumb slippage.

The thumb contacting surface 242 extends outwardly from the proximal end 244 of the thumb support portion along longitudinal axis P—P at an acute angle B with respect to the central longitudinal axis A—A of base portion 230. In the preferred embodiment, the angle of B is between 25 and 30 degrees and most preferably is about 27 degrees. This angle maintains operator's thumb enough outwardly of the index finger to avoid lateral pinch. The proximal end 244 of the thumb support portion 232 extends beyond the base portion proximal and 236, while the distal end 246 of the thumb support portion 232 extends beyond the distal end 248 of the base portion.

Cavities 250 and 252 near the interface of the base portion 230 and the thumb support portion 232 provide clearance between the thumbpiece 208 and the handle end 238 and between the thumbpiece 208 and the boss shoulder 220 respectively when the knife 200 is assembled.

While the invention has been described with particularity with respect to preferred constructions, it will be apparent that various modifications and alterations can be made therein without departing from the spirit and scope of the invention as set forth in the appended claims.

I claim:

1. A thumbpiece in combination with a power-driven knife, said knife comprising a headpiece and an elongated handle removably attached to said headpiece, an annular boss extending from the headpiece, said boss having an outer peripheral surface with a plurality of spaced apart parallel grooves, said thumbpiece comprising an annular base portion and a thumb supporting portion on the base portion, said base portion having a central axis and an inner peripheral surface with a spline parallel to the central axis and disposed diametrically opposite said thumb supporting portion axially along the inner peripheral surface, said base portion adapted to encircle said boss with said spline engaging a selected one of said parallel grooves thereby preventing rotation of said thumbpiece with respect to said headpiece, said thumb supporting portion having a proximal and a distal end and including a patterned thumb contacting surface extending outwardly from said proximal end of said thumb supporting portion at an acute angle with respect to the central axis of the base portion, said thumb contacting surface being generally sinusoidal along its length and concave in a direction transverse to its length for supporting an operator's thumb in a partially flexed position along the length of said thumb during operation of said knife.

2. The combination as set forth in claim 1 wherein said spline of said thumbpiece base portion extends a distance substantially one-half of said base portion's axial length.

3. The combination as set forth in claim 1 wherein said acute angle of said thumbpiece thumb contacting surface is between 25 and 30 degrees.

4. The combination as set forth in claim 1 wherein said thumbpiece base portion has a proximal and a distal end, said proximal end of said thumb supporting portion extending outwardly beyond said proximal end of said base portion and said distal end of said thumb supporting portion extending outwardly beyond ;aid distal end of said base portion.

5. A thumbpiece for a power-driven knife, which knife includes a driven blade supported by a headpiece and an elongated handle, said thumbpiece comprising a base portion and a thumb supporting portion disposed on said base portion, said base portion having a longitudinal axis and including a securing means for removably securing said thumbpiece to said headpiece and preventing rotation of said thumbpiece with respect to said headpiece, said thumb supporting portion having a proximal end and a distal end and including a patterned thumb contacting surface extending outwardly from said proximal end of said thumb supporting portion at an acute angle with respect to the longitudinal axis of said base portion, said thumb contacting surface being generally sinusoidal along its length and concave in a direction transverse to its length, whereby an operator's thumb is maintained in a partially flexed position and is supported along the length of said thumb when the handle is gripped and the operator's thumb is placed on said thumb contacting surface.

6. A thumbpiece as set forth in claim 5 wherein said base portion has a proximal and a distal end, said proximal end of said thumb supporting portion extending outwardly beyond said proximal end of said base portion and said distal end of said thumb supporting portion extending outwardly beyond said distal end of said base portion.

7. A thumbpiece as set forth in claim 5 wherein said base portion securing means comprises an annular ring having an inner peripheral surface, a raised spline on the inner peripheral surface disposed diametrically opposite said thumb supporting portion and extending axially of the ring, said annular ring adapted to encircle a boss extending from said headpiece and said raised spline adapted to engage a selected one Of a plurality of grooves spaced apart on an outer periphery of said boss thereby preventing rotation of said thumbpiece with respect to said headpiece.

8. A thumbpiece as set forth in claim 7 wherein said spline extends a distance substantially one-half of said base portion's axial length.

9. A thumbpiece as set forth in claim 5 wherein said acute angle is between 25 and 30 degrees.

10. A thumbpiece as set forth in claim 5 wherein said sinusoidal thumb contacting surface when viewed along its length includes a central concave portion, a first convex portion adjacent said proximal end of said thumb supporting portion and a second convex portion adjacent said distal end of said thumb supporting portion.

11. A power-driven knife having a headpiece for supporting an annular rotary blade, an elongated handle removably attached to said headpiece and a thumbpiece comprising a base adapted to be secured between said headpiece and said handle and a thumb support portion including a thumb contacting surface that is sinusoidal along its profile and concave in a direction transverse to its profile, said thumb support portion extending from the base and said thumb contacting surface located outwardly from the handle and extending at an acute angle to the direction of elongation of the handle.

12. A power-driven knife as set forth in claim 11 wherein said base of said thumbpiece includes a ring constructed to encircle a portion of said knife and an engagement member which cooperates with an engagement member on said knife to prevent rotation relative to said headpiece.

13. A power-driven knife as set forth in claim 11 wherein the acute angle of the thumbpiece thumb contacting surface is between 25 and 30 degrees.

14. A power-driven knife as set forth in claim 11 wherein said thumbpiece thumb contacting surface includes a central concave surface region, a convex surface region near a proximal end of the thumb contacting surface and a second convex surface region near a distal end of the thumb contacting surface.

15. A thumb support surface of a power-driven knife, which knife includes a driven blade supported by an elongated handle having a central axis, said thumb support surface located outwardly of said handle and extending along a longitudinal axis that forms an acute angle with said handle central axis, the surface being generally sinusoidal along the longitudinal axis and concave transverse to the longitudinal axis whereby an operator's thumb is maintained in a partially flexed position and is supported along the length of said thumb when the handle is gripped and the operator's thumb is placed on said surface.

16. The thumb support surface of claim 15 wherein said acute angle is between 25 and 30 degrees.

* * * * *